US007503402B2

(12) United States Patent
Ookubo

(10) Patent No.: US 7,503,402 B2
(45) Date of Patent: Mar. 17, 2009

(54) POWER TOOL HAVING LUBRICANT LEAKAGE PREVENTING STRUCTURE

(75) Inventor: Takahiro Ookubo, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/266,174

(22) Filed: Nov. 4, 2005

(65) Prior Publication Data

US 2006/0096768 A1 May 11, 2006

(30) Foreign Application Priority Data

Nov. 5, 2004 (JP) ..... P2004-321520
Nov. 5, 2004 (JP) ..... P2004-321540

(51) Int. Cl.
*B25D 9/00* (2006.01)

(52) U.S. Cl. ..... 173/217; 173/205; 173/216

(58) Field of Classification Search ..... 173/217, 173/171, 100, 205, 216
See application file for complete search history.

(56) References Cited

U.S. PATENT DOCUMENTS 3,630,293 A * 12/1971 Moores, Jr. ..... 173/117
3,685,594 A * 8/1972 Koehler ..... 173/48
3,736,992 A * 6/1973 Zander et al. ..... 173/48
3,998,278 A * 12/1976 Stiltz et al. ..... 173/13
4,113,035 A * 9/1978 Stiltz et al. ..... 173/201
4,991,472 A * 2/1991 Hollingsworth ..... 81/464
6,226,877 B1 * 5/2001 Ono ..... 30/392
6,237,699 B1 * 5/2001 Plietsch et al. ..... 173/201
2003/0121683 A1 7/2003 Lebisch et al.
2003/0201110 A1 * 10/2003 Bednar ..... 173/216
2005/0034881 A1 * 2/2005 Berger et al. ..... 173/2

FOREIGN PATENT DOCUMENTS

| | | |
|---|---|---|
| DE | 84 31 462 | 8/1987 |
| DE | 101 45 296 | 4/2003 |
| EP | 1 327 497 | 7/2003 |
| GB | 2 399 784 | 9/2004 |
| JP | 1-316178 | 12/1989 |

* cited by examiner

*Primary Examiner*—Brian D Nash
(74) *Attorney, Agent, or Firm*—Antonelli, Terry, Stout & Kraus, LLP.

(57) ABSTRACT

A power tool suppressing expansion of the air in a chamber and preventing lubricant encapsulated in the chamber from being leaked outside of the chamber. A communication portion communicates a speed reduction chamber with a motor housing communicating with an atmosphere. A communication passage forming component made from an elastic material is fittingly inserted into the communication portion which forms a communication passage including a plurality of impediment portions. When the air containing lubrication component is passed through the communication passage, the air collides against the impediment portions, allowing grease component to be adhered to the impediment portions.

18 Claims, 5 Drawing Sheets

POWER TOOL HAVING LUBRICANT LEAKAGE PREVENTING STRUCTURE

BACKGROUND OF THE INVENTION

The present invention relates to a power tool having a mechanism for transmitting a rotation of an electric motor, and more particularly, to such power tool having a structure for preventing leakage of lubricant.

An electronic motor is mounted in the housing of a power tool such as a hammer drill. A cylinder driven by the electric motor is rotatably supported at the leading end of the housing, and an end tool is attached to the leading end of the cylinder. Further, a speed reduction mechanism is provided in the housing. Through the speed reduction mechanism, a rotation of the electric motor is transmitted to the end tool.

The speed reduction mechanism is housed in a mechanism chamber defined by the housing and has a rotation transmission mechanism including a gear and an intermediate shaft. A rotation of the electric motor is transmitted to the intermediate shaft by the gear and then transmitted to the end tool. A bearing is provided within the mechanism chamber at the positions corresponding to both end portions of the intermediate shaft for rotatably supporting the intermediate shaft.

A lubricant is applied to the gear, intermediate shaft, and the like of the speed reduction mechanism for increase in durability and reduction in friction loss. As the lubricant, used is grease containing a metallic soap base such as Ca and Li and an oil component such as silicon oil. The grease has a high fluidity and is soft, so that the lubrication ability of the grease is not impaired even at low temperature environment. The soft grease contains a large amount of oil component. Therefore, a high temperature increases fluidity, with the result that the soap base and oil component tend to be separated from each other. Accordingly, high sealing performance is required for the mechanism chamber in order to prevent the grease from flowing out of the mechanism chamber. In order to realize the high sealing performance, a plurality of types of seal members such as an O-ring, an oil seal, a contact type sealed ball bearing are used for the mechanism chamber. The power tool having the above configuration is disclosed in, for example, laid-open Japanese Patent Application Publication No. H1-316178.

In a conventional power tool, as described above, different types of seal members are used in individual portions to be sealed to realize a sealing structure of the mechanism chamber. Accordingly, sealing performance differs depending on the individual portions. When the speed reduction mechanism becomes feverish during use of such a power tool, temperature within the sealed mechanism chamber is increased to expand the air inside the mechanism chamber. In this case, if the sealing performance of only one of the above-mentioned different types of seal members is degraded, the expanded air and the grease flow outside of the mechanism chamber through the position corresponding to the seal member whose sealing performance has been degraded. The leakage of the grease may not only degrade quality and durability of the product, but also smear a working area.

There is an available power tool having a conversion mechanism that converts a rotary motion into a reciprocation motion and uses the conversion mechanism to reciprocate a cylindrical piston mounted in the housing. The electrical tool has, in the housing, an impacting power transmission mechanism that reciprocates a striker and intermediate member in accordance with the reciprocation motion of the cylindrical piston to transmit a striking power to the end tool. To this effect, the piston, striker, and intermediate member must be reciprocated at high speed. Therefore, relatively a large amount of grease having high fluidity needs to be put in the mechanism chamber. Further, a heat generated by the high speed reciprocation motion significantly increases pressure in the mechanism chamber. Under the circumstances, the grease whose fluidity has been increased due to the application of the heat easily flowed through the seal position to the outside of the mechanism chamber.

SUMMARY OF THE INVENTION

It is therefore, an object of the present invention to provide a power tool that suppresses expansion of the air in the mechanism chamber and prevents the lubricant encapsulated in the mechanism chamber from being leaked outside of the mechanism chamber to thereby increase quality and durability of the tool.

This and other objects of the invention will be attained by a power tool including a housing, an electric motor, a speed change mechanism, a communication forming portion, and a communication passage forming member. The housing defines therein a mechanism chamber, and a lubricant is inserted in an interior of the mechanical chamber. The electric motor is accommodated in the housing. The speed change mechanism is disposed in the mechanism chamber and is connected to the motor for shift-transmitting rotation of the motor. The communication forming portion is provided in the housing. The communication passage forming member is fitted in the communication forming portion for providing a communication passage communicating an interior of the mechanism chamber with an exterior of the mechanism chamber. The communication passage forming member provides at least one impediment portion that restrains leakage of the lubricant to the exterior of the mechanism chamber.

In another aspect of the invention, there is provided a power tool including the housing, the electric motor, the speed change mechanism, the communication forming portion provided in the housing and formed with a communication portion having an inlet open to the mechanism chamber and an outlet in communication with the inlet, a first filter, and a second filter. The first filter is disposed for blocking the communication portion and is positioned close to the inlet. The second filter is disposed for blocking the communication portion and is positioned close to the outlet.

DETAILED DESCRIPTION OF THE PREFERRED EMBODIMENTS

Figure 1:
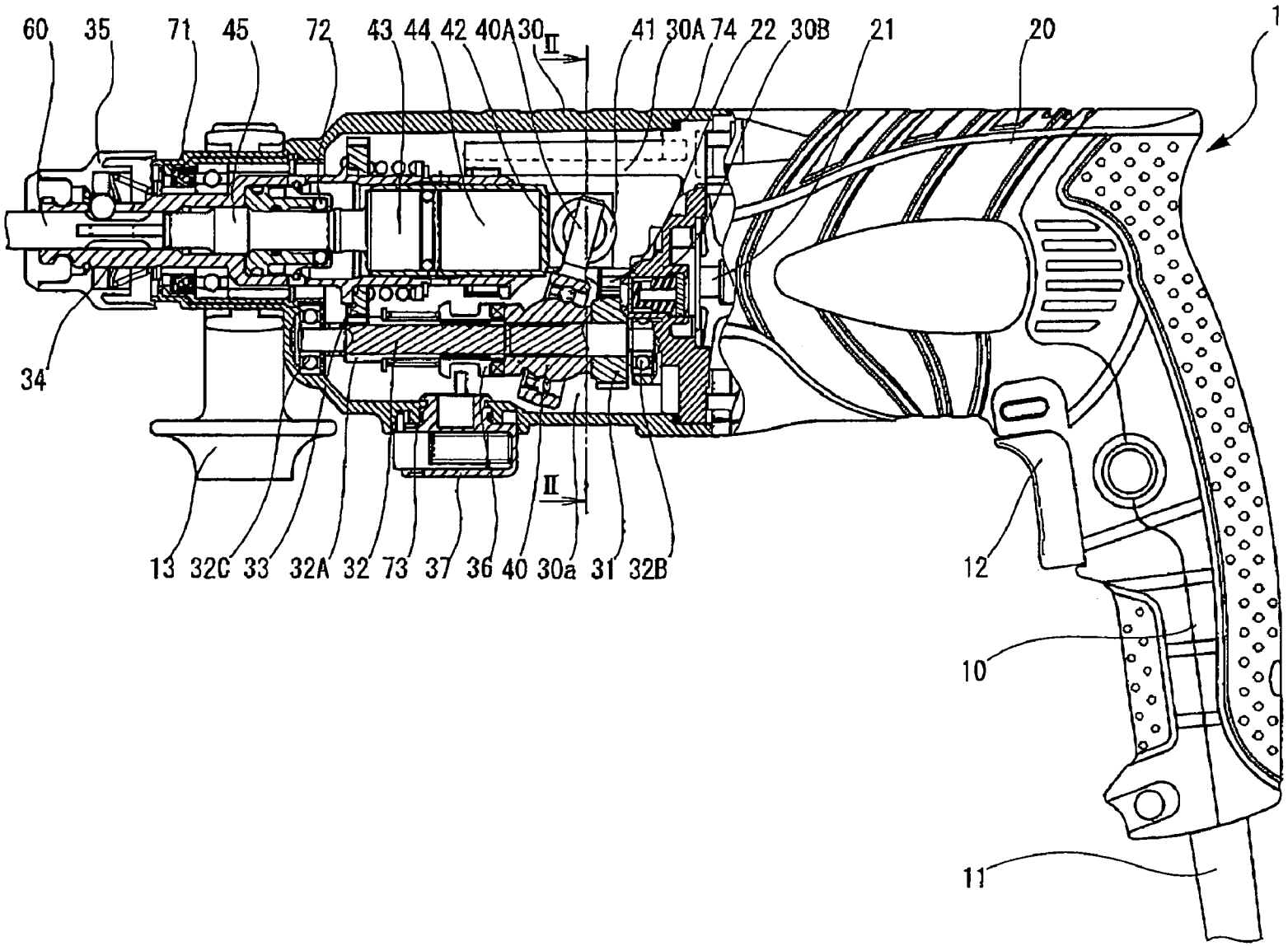
FIG. 1 is a cross-sectional view showing an entire hammer drill according to a first embodiment of the present invention.

A power tool according to a first embodiment of the present invention will be described below with reference to FIGS. 1 to 3. The power tool is, as shown in FIG. 1, a hammer drill 1 including a handle portion 10, a motor housing 20, and a gear housing 30 those constituting a casing.

An electric cable 11 is attached to, and a switch mechanism (not shown) is incorporated in the handle portion 10. To the switch mechanism, a user-operable trigger 12 is mechanically connected. The electric cable 11 connects the switch mechanism to an external power supply (not shown). A user operates the trigger 12 to thereby switch connection and disconnection between the switch mechanism and power supply.

The motor housing 20 is provided above the handle portion 10. The handle portion 10 and motor housing 20 are integrally formed from plastic material. An electric motor (not shown) is housed in the motor housing 20. The motor housing 20 has an output shaft 21 for outputting a driving force.

The gear housing 30 is a resin-molded part provided in front of the motor housing 20. A support member 30A formed from a metal is provided inside the gear housing 30 to partition the gear housing 30 from the motor housing 20. The gear housing 30 and support member 30A define a speed reduction chamber 30*a* which is a mechanism chamber that houses a rotation transmission mechanism to be described later. The gear housing 30 including the speed reduction chamber 30*a* contains grease serving as lubricant for reducing friction of gears to be described later. The grease is supplied to respective rubbing portions. The main components of the grease are soap base and oil content such as silicon oil.

In the gear housing 30, an intermediate shaft 32 extending parallel to the output shaft 21 is supported by the gear housing 30 and support member 30A through bearings 32B and 32C so as to be rotatable about the axis of the intermediate shaft 32. The bearings 32B and 32C that support the intermediate shaft 32, each of which is a ball bearing with seal (non-contact type), are provided at both end portions of the intermediate shaft 32 and held by a part of the gear housing 30 and support member 30A. Further, a side handle 13 is provided near a tool holder 35 (to be described later) of the gear housing 30.

A motor pinion gear 22 is provided at the leading end of the output shaft 21. A first gear 31 meshingly engaged with the motor pinion gear 22 is coaxially fixed to the intermediate shaft 32 at the electric motor side. A gear section 32A is formed at the leading end side of the intermediate shaft 32 and is meshingly engaged with a second gear 33 (described later). The support member 30A and the casing constituted by the handle portion 10, motor housing 20, and gear housing 30 define in combination a housing.

A cylinder 34 is provided in the gear housing 30 at the portion above the intermediate shaft 32. The cylinder 34 extends parallel to the intermediate shaft 32 and is rotatably supported by the support member 30A. The second gear 33 is fixed to the outer circumference of the cylinder 34. The meshing engagement between the second gear 33 and gear section 32A allows the cylinder 34 to be rotated about an axis of the cylinder 34.

The above-mentioned tool holder 35 is provided at the leading end side of the cylinder 34 for detachably holding an end tool 60. The support member 30A thus supports the motor pinion gear 22, intermediate shaft 32, and cylinder 34, so that a higher mechanical strength is required for the support member 30A as compared to the gear housing 30 and motor housing 20. Therefore, the support member 30A is made from a metal.

A clutch 36 that is biased by a spring in the direction toward the electric motor is splined to the middle potion of the intermediate shaft 32. The clutch 36 can be switched, by a change lever 37 provided at the lower portion of the gear housing 30, between hammer drill mode (position shown in FIG. 1) and drill mode (the clutch 36 is moved to the position on the leading end side of the intermediate shaft 32). A motion conversion section 40 that converts a rotary motion into a reciprocation motion is rotatably disposed over the intermediate shaft 32 at the portion on the electric motor side of the clutch 36. The motion conversion section 40 has an arm portion 40A reciprocally movable in the longitudinal direction of the hammer drill 1 by the rotation of the intermediate shaft 32.

At the time when the clutch 36 is positioned at the hammer drill mode through the change lever 37, the clutch 36 connects the intermediate shaft 32 to the motion conversion section 40. The motion conversion section 40 is connected to a piston 42 provided in the cylinder 34 through a piston pin 41 so as to operate simultaneously with the piston 42. The piston 42 is reciprocally movably disposed within the cylinder 34 in the direction parallel to the intermediate shaft 32 in a sliding manner with respect to the cylinder 34. A striker 43 is installed in the piston 42, and an air chamber 44 is defined in the cylinder 34 and between the piston 42 and striker 43. An intermediate member 45 is supported in the cylinder 34 at the portion on the opposite of the air chamber with respect to the striker 43 so as to be slidable in the moving direction of the piston 42. The end tool 60 is located at the portion on the opposite side of the striker with respect to the intermediate member 45. The striker 43 therefore strikes the end tool 60 through the intermediate member 45.

A rotation output of the motor is transmitted from the motor pinion gear 22 to the intermediate shaft 32 through the first gear 31. The rotation of the intermediate shaft 32 is then transmitted to the cylinder 34 through the meshing engagement between the gear section 32A and second gear 33 disposed over the cylinder 34. Thus, the end tool 60 is rotated. When the clutch 36 is shifted to the hammer drill mode through the change lever 37, the clutch 36 is connected to the motion conversion section 40 to transmit the rotation of the intermediate shaft 32 to the motion conversion section 40. The motion conversion section 40 allows the piston pin 41 to convert the rotation into a reciprocation motion of the piston 42. The reciprocation motion of the piston 42 causes the air in the air chamber 44 defined between the striker 43 and piston 42 to be repeatedly compressed and expanded, thereby imparting a striking force to the striker 43. The striker 43 then moves forward to butt the rear end surface of the intermediate member 45 and the striking force is transmitted to the end tool 60 through the intermediate member 45. As described above, in the hammer drill mode, the rotation force and striking force are simultaneously imparted to the end tool 60.

At the time when the clutch 36 is shifted to the drill mode, the clutch 36 disconnects the connection between the intermediate shaft 32 and motion conversion section 40 to allow the rotation of the intermediate shaft 32 to be transmitted to the cylinder 34 through the gear section 32A and second gar 33. Accordingly, in the drill mode, only the rotation is imparted to the end tool 60.

The speed reduction chamber 30*a* that is defined by the gear housing 30 and houses the rotation transmission mechanism is sealed by a plurality of types of seal members. These seal members prevent the grease from being leaked outside the gear housing 30.

More specifically, an oil seal 71 is provided between an outer peripheral surface of the cylinder 34 and gear housing 30, an O-ring 72 is mounted to an inner peripheral surface of the cylinder 34 that supports the intermediate member 45, and an O-ring 73 is mounted at the connection portion between the change lever 37 and gear housing 30. Further, an O-ring 74 is mounted at the connection portion between the support member 30A and gear housing 30. A bearing (not shown) that supports the motor pinion gear 22 is formed by a sealed ball bearing (contact type) and contributes to the sealing of the speed reduction chamber 30*a*.

Figure 2:
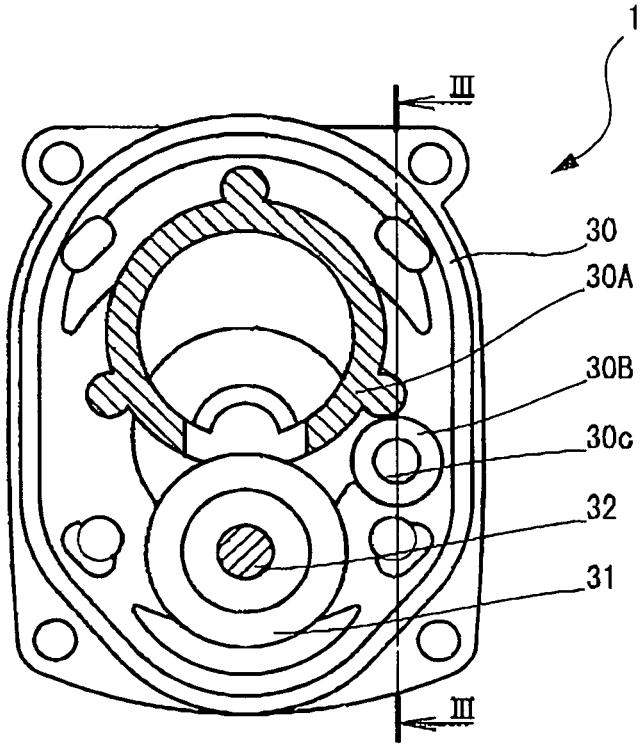
FIG. 2 is a cross-sectional view taken along the line II-II in FIG. 1.
Figure 3:
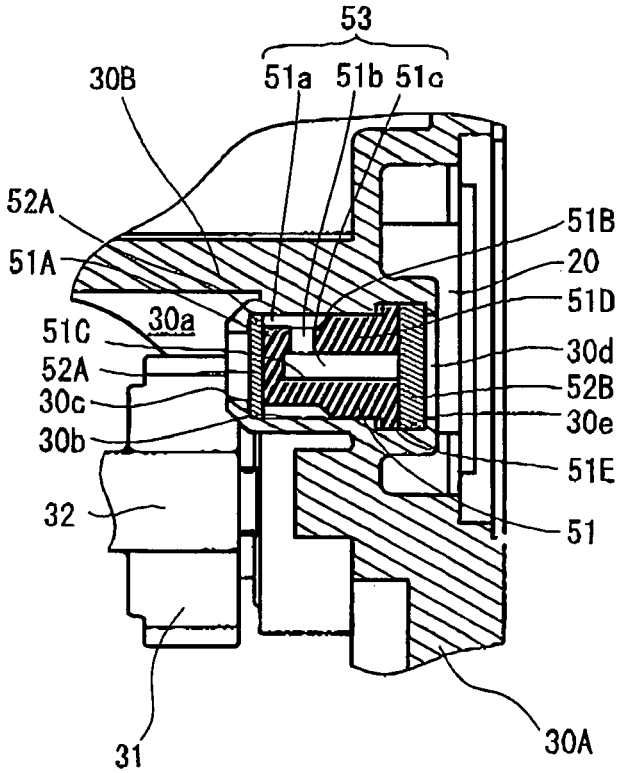
FIG. 3 is a detailed cross-sectional view taken along the line III-III in FIG. 2.

As shown in FIGS. 1 and 2, a communication forming portion 30B is provided at the support member 30A. The communication forming portion 30B is located in substantially the middle portion between the intermediate shaft 32 and cylinder 34 and is located on the right side of the support member 30A as viewed from the end tool 60 side toward the support member 30A as shown in FIG. 2. The communication forming portion 30B has, as shown in FIG. 3, an inlet 30*c* open to the speed reduction chamber 30*a* and an outlet 30*d* open to the inside of the motor housing 20 that communicates with an atmosphere. The communication forming portion 30B has a communication portion 30*b* for communicating the inlet 30*c* with the outlet 30*d*. An inner diameter of the communication portion 30*b* is slightly larger than that of the inlet 30*c*. Further, an annular groove portion 30*e* is provided on an inner circumference of the communication portion 30*b* at a position near the outlet 30*d*.

A first filter 52A made from a coarse felt is fitted in the end portion of the communication portion 30*b* on the side of the inlet and covers the opening of the communication portion 30*b*. The outer diameter of the first filter 52A is equal to or slightly larger than the inner diameter of the communication portion 30*b*. The thickness of the first filter 52A is made smaller than that of a second filter 52B (described later) for preventing clogging at the filter. Further, since the inner diameter of the communication portion 30*b* is slightly larger than that of the inlet 30*c*, positioning of the first filter 52A can be easily performed.

By using the felt as a material of the first filter 52A and second filter 52B (described later), the thickness and density of the filter can be easily changed, which allows the filtration capability of the filter to be easily changed. Further, the felt is easy to be processed, in particular, easy to be cut off. Therefore, productivity can be increased.

A communication passage forming component or member 51 is inserted into the communication portion 30*b* and is positioned on the outlet side of the first filter 52A. The communication passage forming component 51 has a head portion 51A, a trunk portion 51D, and a flange portion 51E. The head portion 51A has one end in contact with the first filter 52A and has an outer diameter smaller than the inner diameter of the communication portion 30*b*. The trunk portion 51D is located on the other end side of the head portion 51A and has a diameter larger than the inner diameter of the communication portion 30*b* in a state where the communication passage forming component 51 is not fitted in the communication portion 30*b*. The flange portion 51E is located on the second filter 52B side and fitted in the annular groove portion 30*e*. The communication passage forming component 51 is made from an elastic material such as an oil resistant rubber material.

Since the communication passage forming component 51 is made from the rubber material, the communication passage forming component 51 can easily be deformed and force-fitted to the communication portion 30*b*. Further, the flange portion 51E can easily be fitted in the annular groove portion 30*e*. Furthermore, when the communication passage forming component 51 is fitted in the communication portion 30*b*, the communication passage forming component 51 can be firmly attached to the communication portion 30*b* because of the diametrical difference therebetween. Therefore, formation of an inadvertent minute gap between the trunk portion 51D and communication portion 30*b* can be avoided to prevent the lubricant and the like from being leaked through the inadvertent minute gap. Further, mutual displacement between the trunk portion 51D and communication portion 30*b* hardly occurs. Moreover, only force-fitting work is required for fixing the communication passage forming component 51 to a desired position of the communication portion 30*b*, eliminating particular fixing arrangement. This simplifies the assembleability.

Further, the fitting of the flange portion 51E with the annular groove portion 30*e* can fix the position of the communication passage forming component 51 with respect to the communication portion 30*b*. This can make the size of a communication passage 53 (described later) defined by the communication passage forming component 51 and the inner surface of the communication portion 30*b* suitable and uniform.

An axial hole 51*c* is formed in the communication passage forming component 51. The axial hole 51*c* has an opening at the portion on the second filter 52B side of the trunk portion 51D and extends from the opening up to an axially middle potion of the head portion 51A. In the head portion 51A, a radial hole 51*b* is formed. The radial hole 51*b* extends through the head portion 51A in the direction perpendicular to the axial hole 51*c* from the inside of the axial hole 51*c* toward the inner surface of the communication portion 30*b*. Accordingly, a bend portion exists at the portion where the radial hole 51*b* and axial hole 51*c* are intersected to each other. The outer diameter of the head portion 51A is smaller than the inner diameter of the communication portion 30*b*, so that an annular space 51*a* is provided between the inner surface of the communication portion 30*b* and head portion 51A. The annular space 51*a* extends from the portion where the head portion 51A contacts the first filter 52A. The radial hole 51*b* opens to the surface of the head portion 51A that faces the inner surface of the communication portion 30*b* and, therefore, the radial hole 51*b* communicates with the space 51*a*. Since the radial hole 51*b* opens to the inner surface that defines the space 51*a*, a bend portion exists at the portion where the space 51*a* and radial hole 51*b* are connected to each other. The space 51*a*, radial hole 51*b*, and axial hole 51*c* constitute the communication passage 53 with the space 51*a* defined as the upstream side. Since the communication passage forming component 51 is made from the rubber material as described above, the communication passage 53 having a complicated configuration can be easily formed.

Since the trunk portion 51D has the outer diameter greater than that of the head portion 51A, a stepped portion exists at a boundary between the trunk portion 51D and head portion 51A. Further, the trunk portion 51D is in communication with the inner space of the communication portion 30*b*, forming a dead-end alley at the stepped portion between the trunk portion 51D and head portion 51A. The stepped portion is referred to as a first impediment portion 51B. A fluid flowing through the space 51*a* once collides against the first impediment portion 51B and flows into the radial hole 51*b* extending perpendicular to the direction that the fluid flows in the space 51*a*. A part of the inner peripheral surface of the axial hole 51*c* that faces the opening of the radial hole 51*b* is referred to as a second impediment portion 51C. The fluid flowing from the radial hole 51*b* collides against the second impediment portion 51C. After that, the fluid flows along the axial hole 51*c*. Throughout the specification, "impediment portion" can also be referred to as "collision portion".

Further, in the communication portion 30*b*, the second filter 52B is fitted in the annular groove portion 30*e* which is located on the outlet 30*d* side of the communication passage forming component 51 and covers the opening of the communication portion 30*b*. The second filter 52B is made from a felt material thicker and denser than the felt of the first filter 52A. Therefore, the filtering capability of the second filter 52B is higher than that of the first filter 52A. Since the second filter 52B is fitted in the annular groove portion 30*e*, the communication passage forming component 51 is biased toward the inlet 30*c* side. Further, since the head portion 51A contacts the first filter 52A, the first filter 52A is biased toward the part of the communication forming portion 30B around the opening of the inlet 30*c*.

Drilling operation using the hammer drill 1 will be described. When performing drilling using the hammer drill 1, a user firstly holds the side handle 13 and handle portion 10 with both hands and pulls the trigger 12. Thus, an electrical power is supplied to the motor to drive the motor. The motive energy of the motor is transmitted by the rotation transmission mechanism including the motor pinion gear 2, first gear 31, intermediate shaft 32, gear section 32A, second gear 33, and the like to the end tool 60 as a rotation force. Although the friction loss of the driving force is reduced since the grease is supplied to the respective gears, a slight friction occurs and the friction is converted into heat energy to generate heat. Further, the rotation force is converted into a reciprocation force through the motion conversion section 40 to allow the piston 42 and intermediate member 45 to generate striking force. In this case, the air is compressed in the air chamber 44 in the piston 42 to generate heat of compression and a part of kinetic energy by the impact of the striker 43 against the intermediate member 45 is converted into heat energy to generate heat.

These heat generation factors heats the inside of the gear housing 30, with the result that the encapsulated grease becomes feverish. When the grease becomes feverish and the fluidity of the grease is increased, the grease becomes easy to be separated into the soap base and oil component. Further, since the air exists in the gear housing 30, the volume of the air is expanded when the gear housing 30 is heated. Air-tightness is secured at the respective seal portions, so that the heated and expanded air is discharged to the atmosphere through the communication portion 30*b* permitting communication between the speed reduction chamber 30*a* and the atmosphere.

The heated air in the gear housing 30 contains grease component. When the air containing grease component is passed through the first filter 52A, the soap base having relatively high viscosity and having large particles in solid or droplet form contained in the grease are trapped by the first filter 52A. That is, the oil component in the grease and air are passed through the first filter 52A.

The air and the like that have passed through the first filter 52A is passed along the communication passage 53 and reach the second filter 52B. The communication passage 53 has, in the middle of the passage structure, a plurality of bend portions, where the first and second impediment portions 51B and 51C are defined. Accordingly, the air that has been passed through the first filter 52A and still contains the grease component collides against the first and second impediment portions 51B and 51C and the flow of the air is disturbed to allow the grease component in the air to be adhered to the first and second impediment portions 51B and 51C.

The air and the like that have been passed through the communication passage 53 flows into the second filter 52B. Since the second filter 52B has filtration capability higher than that of the first filter 52A, the second filter 52B can trap oil component and the like contained in the air. Thus, the second filter 52B filters the oil component that has been passed along the communication passage 53, thus preventing the oil component from being discharged outside the second filter 52B. Therefore, the grease contained in the air and flowing through the communication passage 53 can be removed by the time when the air has been passed through the second filter 52B, thus preventing the grease from being discharged outside of the communication portion 30*b*. Further, the communication passage 53 has a complicated configuration including bend portions and the like, restraining the liquid grease from draining along the wall surface of the communication passage 53 due to fluidity or surface tension of the liquid grease. As a result, leakage of the grease to the outside can be restrained or prevented.

After stopping operation of the hammer drill 1, the speed reduction chamber 30*a* and the like are subjected to natural cooling to cool the internal air, resulting in the reduction in the volume of the air. As a result, the speed reduction chamber 30*a* assumes a negative pressure to allow the outside air to flow into the speed reduction chamber 30*a* through the second filter 52B, communication passage 53, and first filter 52A. At this time, the grease component adhered to the first and second filters 52A and 52B can be given back into the speed reduction chamber 30*a* together with the outside air. As a result, clogging of the first and second filters 52A and 52B hardly occurs and, therefore, the filtration capability of the first and second filters 52A and 52B can be maintained over prolonged period of time.

Marks such as a product name, a trade mark, and the like are marked on the right side surface of the hammer drill 1 as viewed in the direction from the end tool 60 toward the support member 30A. Therefore, at the time when being shipped, the hammer drill 1 is packaged with the right side surface facing upward. Thus, the communication forming portion 30B is also positioned on the right side surface of the hammer drill 1 as viewed in the direction from the end tool 60 toward the support member 30A during shipping. This prevents the grease encapsulated in the speed reduction chamber 30*a* at the time of shipment from being passed along the communication passage 53 and discharged outside. Even after the hammer drill 1 comes to be in the possession of a user, the leakage of grease to the outside can be prevented to notify the user of the storage condition when the hammer drill 1 is not in use by adding note of caution saying, for example, "face right side upward when not in use".

Thus, by the employment of the separate communication passage forming component 51 and first and second filters 52A, 52B, lubricant contained in the form of a mist or liquid in the air is adhered to the impediment portion and the lubricant contained in the air to be discharged from the mechanism chamber to the outside is removed in the communication passage. That is, the lubricant can be prevented from being discharged outside. Further, the formation of the impediment portion 51B, 51C generates a bend portion in the middle of the path structure of the communication passage 53. This makes the structure of the communication passage 53 complicated and thereby prevents the liquid lubricant from draining along the wall surface of the communication passage 53 due to fluidity or surface tension of the liquid lubricant. As a result, leakage of the lubricant to the outside can be prevented. Furthermore, the communication passage 53 is constituted partly by the communication portion 30*b* and mainly by the communication passage forming component 51. Therefore, a complicated communication passage can be easily formed at the separate communication passage forming component 51 prior to assembly of the component 51 into the communication portion 30*b*.

A hammer drill according to a second embodiment of the present invention will next be described with reference to FIG. 4. The second embodiment has the same configuration as that of the first embodiment except for the configuration relating to the communication forming portion 230B, and the description of the same part will be omitted.

Figure 4:
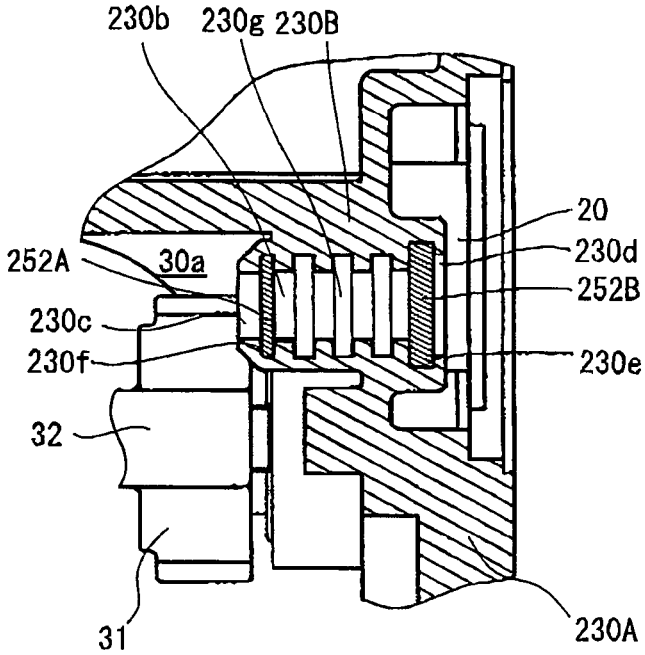
FIG. 4 is a cross-sectional view of an essential portion of a hammer drill according to a second embodiment of the present invention.

As shown in FIG. 4, a communication forming portion 230B is provided in the support member 230A in the gear housing 30. The communication forming portion 230B has an inlet 230*c* open to the speed reduction chamber 30*a* and an outlet 230*d* open to the inside of the motor housing 20 that is communicated with an atmosphere. A communication portion 230*b* communicates the inlet 230*c* and outlet 230*d*. An annular groove portion 230*f* is formed over the inner circumference of the communication portion 230*b* at the portion near the inlet 230*c*. Similarly, annular groove portion 230*e* is formed at the portion near the outlet 230*d*. A concave/convex portion 230*g* having alternating annular projection and annular recess is formed at an inner peripheral surface of the communication portion 230*b* at a position between the annular groove portions 230*f* and 230*e*.

A first filter 252A made from a coarse felt is fitted in the annular groove portion 230*f* and a second filter 252B is fitted in the annular groove portion 230*e*, thereby covering the openings of the communication portion 230*b*. The thickness of the first filter 252A is made smaller than that of the second filter 252B for preventing clogging. The second filter 252B is made of a felt thicker and denser than the felt of the first filter 252A, so that the filtering capability of the second filter 252B is higher than that of the first filter 252A. The existence of the annular groove portion 230*e* and 230*f* can provide easy and accurate positioning of the first and second filters 252A and 252B.

When the air in the speed reduction chamber 30*a* is discharged to the atmosphere through the communication portion 230*b* due to the pressure-increase in the speed reduction chamber 30*a*, the air firstly flows into the communication portion 230*b* from the inlet 230*c*. At this time, the air is passed through the first filter 252A, and the soap base having relatively high viscosity and having large particles in solid or droplet form contained in the grease is trapped. That is, the oil component in the grease and air are passed through the first filter 252A and flow into the second filter 252B. Since filtration capability of the second filter 252B is higher than that of the first filter 252A, the second filter 252B can trap the oil component and the like. The second filter 252B filters the oil component that has been passed along the communication portion 230*b*, thus preventing the oil component from being discharged outside the second filter 252B. Therefore, the grease component contained in the air to be discharged to the atmosphere from the speed reduction chamber 30*a* is removed by the time when the air has been passed through the second filter 252B, thus preventing the grease from being discharged outside of the communication portion 230*b*.

The first filter 252A uses the coarse felt in order to filter out the only soap base contained in the grease and allows the oil component to be passed through the first filter 252A. Therefore, there is a possibility that the oil component in the speed reduction chamber 30*a* gradually permeates into the first filter 252A and enters the communication portion 230*b*. In this case, the existence of the concave/convex portion 230*g* provided along the inner peripheral surface of the communication portion 230*b* prevents the oil component from draining along the communication portion 230*b*. This prevents the oil component in the grease from reaching the second filter 252B and thereby prevents the grease from being discharged outside.

A third embodiment will next be described with reference to FIG. 5. The hammer drill according to the third embodiment has the same configuration as that of the first embodiment except for the configuration relating to the communication forming portion 330B, and the description of the same part will be omitted.

Figure 5:
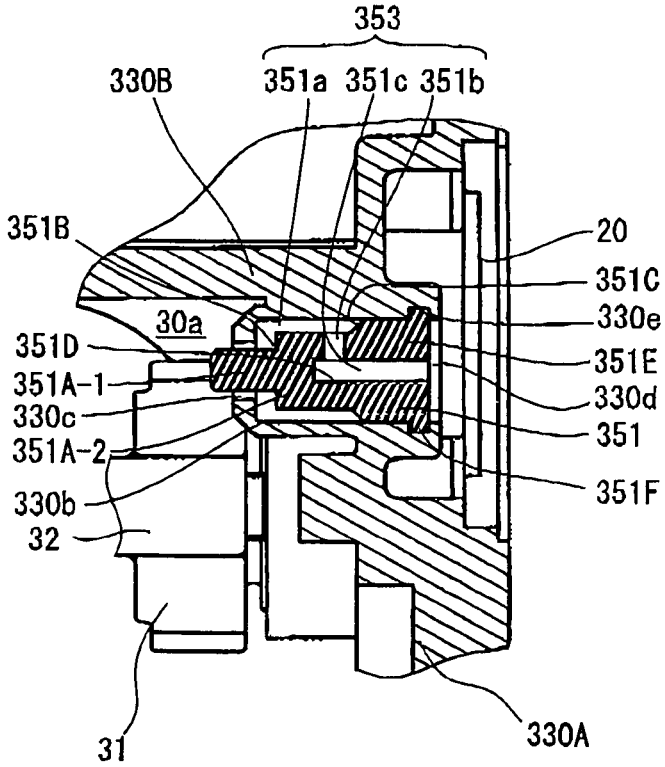
FIG. 5 is a cross-sectional view of an essential portion of a hammer drill according to a third embodiment of the present invention.

As shown in FIG. 5, a communication forming portion 330B is provided in the support member 330A in the gear housing 30, and has an inlet 330*c* open to the speed reduction chamber 30*a* and an outlet 330*d* open to the inside of the motor housing 20 that is in communication with an atmosphere. A communication portion 330*b* communicates the inlet 330*c* with the outlet 330*d*. An annular groove portion 330*e* is formed over the inner peripheral surface of the communication portion 330*b* at the portion near the outlet 330*d*. The inlet has an inner diameter half the inner diameter of the communication portion 330*b*.

A communication passage forming component 351 is inserted into the communication portion 330*b*. The communication passage forming component 351 has a first head portion 351A-1, a second head portion 351A-2, a trunk portion 351E, and a flange portion 351F. The first head portion 351A-1 has an outer diameter smaller than the inner diameter of the inlet 330*c* and has a one end protruding through the inlet 330*c* toward the speed reduction chamber 30*a*. The second head portion 351A-2 is connected to the other end of the first head portion 351A-1 and has an outer diameter smaller than the inner diameter of the communication portion 330*b* but greater than the inner diameter of the inlet 330*c*. The trunk portion 351E is provided at the portion on the outlet 330*d* side of the second head portion 351A-2. The trunk portion 351E has a diameter larger than the inner diameter of the communication portion 330*b* in a state where the communication passage forming component 351 is not fitted in the communication portion 330*b*. A flange portion 351F is formed at the position on the outlet 330*d* side of the trunk portion 351E and is fitted with the annular groove portion 330*e*. The communication passage forming component 351 is made from an oil resistant rubber material.

Because of the rubber material, the communication passage forming component 351 can easily be deformed and inserted to the communication portion 330*b*. Further, the flange portion 351F can be easily fitted in the annular groove portion 330*e*. Further, in a state where the communication passage forming component 351 has been fitted in the communication portion 330*b*, the trunk portion 351E can be attached firmly to the inner surface of the communication portion 330*b* by the elasticity of the rubber material. Therefore, a minute space is hardly formed between the trunk portion 351E and communication portion 330*b*, preventing the grease from being leaked from between the trunk portion 351E and communication portion 330*b*. Further, mutual displacement between the trunk portion 351E and communication portion 330*b* hardly occurs.

Further, the fitting of the flange portion 351F in the annular groove portion 330*e* can fix the position of the communication passage forming component 351 in the communication portion 330*b*, which can make the size of a communication passage 353 (described later) defined by the communication passage forming component 351 and the inner surface of the communication portion 330*b* suitable and uniform.

An axial hole 351*c* is formed in the communication passage forming component 351. The axial hole 351*c* has an opening at the portion on the outlet 330*d* side of the trunk portion 351E and extends from the opening up to substantially the middle potion of the second head portion 351A-2. In the second head portion 351A-2, a radial hole 351*b* is formed. The radial hole 351*b* extends through the second head portion 351A-2 in the direction perpendicular to the axial hole 351*c* from the inside of the axial hole 351*c* toward the inner surface of the communication portion 330*b*. Accordingly, a bend portion exists at the portion where the radial hole 351*b* and axial hole 351*c* are connected to each other. The outer diameter of the second head portion 351A-2 is smaller than the inner diameter of the communication portion 330*b*, so that an annular space 351*a* is formed between the inner surface of the communication portion 330*b* and second head portion 351A-2. The annular space 351*a* extends from the inlet 630A. The radial hole 351*b* opens to the surface of the second head portion 351A-2 that faces the inner surface of the communication portion 330*b* and, therefore, the radial hole 351*b* communicates with the space 351*a*. Since the radial hole 351*b* opens to the inner surface that defines the space 351*a*, a bend portion exists at the portion where the space 351*a* and radial hole 351*b* are connected to each other. The space 351*a*, radial hole 351*b*, and axial hole 351*c* constitute the communication passage 353 with the space 351*a* defined as the upstream side. The communication passage forming component 351 is made from the rubber material as described above, so that a complicated passage of the communication passage 353 can be easily formed.

The communication passage forming component 351 is positioned relative to the communication portion 330*b* by the fitting engagement between the annular groove portion 330*e* and flange portion 351F. In this case, the first head portion 351A-1 is disposed in a predetermined position where one end side of the first head portion 351A-1 protrudes from the inlet 330*c* toward the speed reduction chamber 30*a*. Therefore, the cross-sectional area of the inlet 330*c* is reduced.

A first impediment portion 351B is defined at the boundary portion between the second head portion 351A-2 and the first head portion 351A-1. When a fluid from the inlet 330*c* flows into the space 351*a*, the fluid collides against the first impediment portion 351B. Since the trunk portion 351E has the outer diameter larger than that of the second head portion 351A-2, a stepped portion exists at a boundary between the second head portion 351A-2 and trunk portion 351E. Further, the trunk portion 351E contacts the inner surface of the communication portion 330*b*, forming a dead-end alley at the stepped portion between the second head portion 351A-2 and trunk portion 351E. The stepped portion is defined as a second impediment portion 351C. The fluid flowing into the space 351*a* once collides against the second impediment portion 351C and flows into the radial hole 351*b* extending perpendicular to the direction that the fluid flows into the space 351*a*. A portion of the inner peripheral surface of the axial hole 351*c* that faces the opening of the radial hole 351*b* is defined as a third impediment portion 351D. The fluid flowing through the radial hole 351*b* collides against the third impediment portion 351D. After that, the fluid flows along the axial hole 351*c*.

At the time when a pressure in the speed reduction chamber 30*a* is increased and the air in the speed reduction chamber 30*a* is discharged to the atmosphere through the communication portion 330*b*, the air firstly flows into the communication portion 330*b* through the inlet 330*c*. At this time, since the opening cross-sectional area of the inlet 330*c* is small, the air is passed through the inlet 330*c* at higher speed. In this state, the air collides against the first impediment portion 351B and as a result, the flow of the air is disturbed to allow the grease component in the air to be adhered to the first to third impediment portions 351, 351C and 351D. Accordingly, the grease component is prevented from being discharged outside from the communication portion 330*b*. Further, the communication passage 353 has a complicated path structure including bend portions and the like, preventing the liquid grease from draining along the wall surface of the communication passage 353 due to fluidity or surface tension of the liquid grease. As a result, leakage of the grease to the outside can be prevented.

A fourth embodiment will next be described with reference to FIG. 6. The hammer drill according to the fourth embodiment has the same configuration as that of the first embodiment except for the configuration relating to the communication forming portion 430B, and the description of the same part will be omitted.

Figure 6:
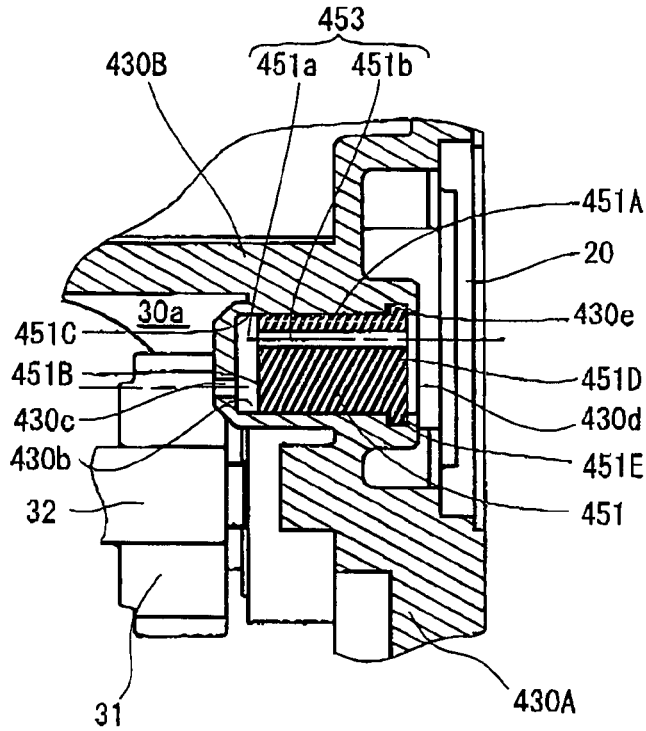
FIG. 6 is a cross-sectional view of an essential portion of a hammer drill according to a fourth embodiment of the present invention.

As shown in FIG. 6, a communication forming portion 430B is provided in a support member 430A in the gear housing 30, and has an inlet 430*c* open to the speed reduction chamber 30*a* and an outlet 430*d* open to the inside of the motor housing 20 that communicates with an atmosphere. A communication portion 430*b* communicates the inlet 430*c* and outlet 430*d*. An inner diameter of the inlet 430*c* is smaller than an inner diameter of the outlet 430*d* and an inner diameter of the communication portion 430*b*. Further, the inlet 430*c* is offset from a central axis of the communication portion 430*b*. An annular groove portion 430*e* is formed in the inner peripheral surface of the communication portion 430*b* at the portion near the outlet 430*d*.

A communication passage forming component 451 is inserted into the communication portion 430*b*. The communication passage forming component 451 has a trunk portion 451A and a flange portion 451D. The trunk portion 451A is formed in a cylindrical shape and has an outer diameter larger than the inner diameter of the communication portion 430*b* in a state where the communication passage forming component 451 is not fitted in the communication portion 430*b*. The flange portion 451D is formed at the portion on the outlet 430*d* side of the trunk portion 451A and is fitted in the annular groove portion 430*e*. The communication passage forming component 451 is made from an oil resistant rubber material. Because of the rubber material, the communication passage forming component 451 can easily be deformed and inserted to the communication portion 430*b*. Further, the flange portion 451D can easily be fitted in the annular groove portion 430*e*. Further, in a state where the communication passage forming component 451 has been fitted in the communication portion 430*b*, the trunk portion 451A is attached firmly to the inner surface of the communication portion 430*b* by the elasticity of the rubber material. Therefore, a minute space is hardly formed between the trunk portion 451A and communication portion 430*b*, preventing the grease from being leaked from between the trunk portion 451A and communication portion 430*b*. Further, mutual displacement between the trunk portion 451A and communication portion 430*b* does not occur after assembly.

Further, the fitting of the flange portion 451D in the groove portion 430*e* can fix the position of the communication passage forming component 451 in the communication portion 430*b*. This can make the size of a communication passage 453 (described later) defined by the communication passage forming component 451 and the inner surface of the communication portion 430*b* suitable and uniform.

An axial hole 451*b* is formed in the trunk portion 451A. The axial hole 451*b* has one end opening at the inlet 430*c* side and another end opening at the outlet 430*d* side. The communication passage forming component 451 is inserted into the communication portion 430*b* such that the inlet opening of the axial hole 451*b* is offset from the inlet 430*c*. Further, a predetermined cylindrical space 451*a* is formed between the one end surface of the trunk portion 451A and a part of the communication forming portion 430B providing the inlet 430*c*, and the space 451*a* is in communication with the axial hole 451*b*. Accordingly, the flowing direction in the inlet 430*c* is made perpendicular to the flowing direction in the space 451*a*, so that, a bend flowing portion exists at the portion where the inlet 430*c* and the space 451 are connected to each other. Further, the flow direction in the space 451*a* is made perpendicular to the flowing direction in the axial hole 451*b*, so that another bend flowing portion also exists at the portion where the space 451*a* and axial hole 451*b* are connected to each other. The space 451*a* and axial hole 451*b* constitute the communication passage 453 with the space 451*a* defined as the upstream side. The communication passage forming component 451 is made from the rubber material and separated from the support member 430A, so that a complicated path of the communication passage 453 can easily be formed.

A first impediment portion 451B is defined on the surface of the trunk portion 451A that faces the inlet 430*c*. The fluid flowing from the inlet 430*c* can collide against the first impediment portion 451B. Further, a second impediment portion 451C is defined on the inner surface of the communication portion 430*b* at a position near the axial hole 451*b*. When the fluid from the space 451*a* flows into the axial hole 451*b*, the fluid once collides against the second impediment portion 451C, and then flows into the axial hole 451*b*.

When a pressure in the speed reduction chamber 30*a* is increased as described above and the air in the speed reduction chamber 30*a* is discharged to the atmosphere through the communication portion 430*b*, the air firstly flows into the communication portion 430*b* through the inlet 430*c*. At this time, since the opening cross-sectional area of the inlet 430*c* is small, the air is passed through the inlet 430*c* at an accelerated speed. In this state, the air collides against the first impediment portion 451B and thus, the flow of the air is disturbed to allow the grease component in the air to be adhered to the first and second impediment portions 451B and 451C. As a result, the grease component is prevented from being discharged outside from the communication portion 430*b*. Further, the communication passage 453 has a complicated path structure including bend portions and the like, preventing the liquid grease from draining along the wall surface of the communication passage 453 due to fluidity or surface tension of the liquid grease. As a result, leakage of the grease to the outside can be prevented.

Although the filter is not used in the fourth embodiment, filters can be disposed in at least one of the inlet and outlet positions of the communication passage 453 as in the case of the first embodiment, which further prevents the grease component from being discharged to the atmosphere.

A fifth embodiment will next be described with reference to FIG. 7. The hammer drill according to the fifth embodiment has the same configuration as that of the first embodiment except for the configuration relating to the communication forming portion 530B, and the description of the same part will be omitted.

Figure 7:
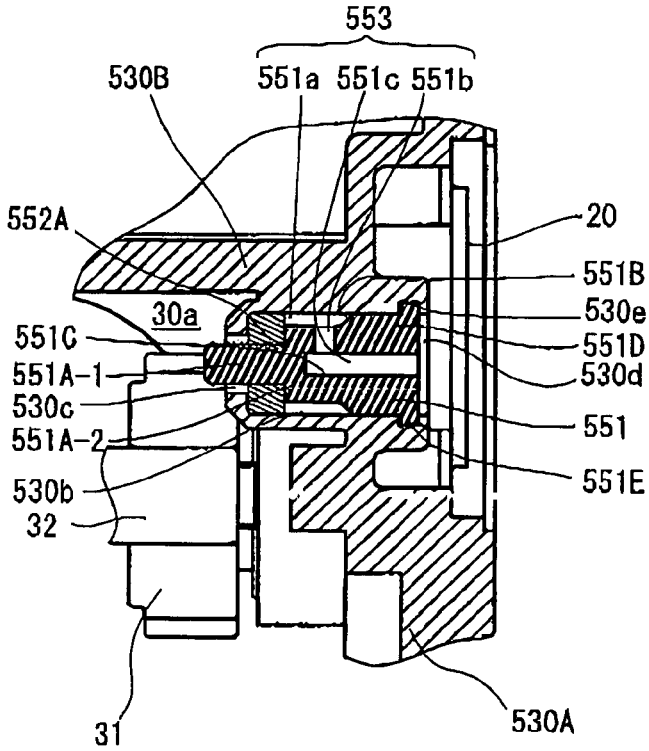
FIG. 7 is a cross-sectional view of an essential portion of a hammer drill according to a fifth embodiment of the present invention.

As shown in FIG. 7, a communication forming portion 530B is provided in the support member 530A in the gear housing 30, and has an inlet 530*c* open to the speed reduction chamber 30*a* and an outlet 530*d* that opens to the inside of the motor housing 20 that communicates with an atmosphere. A communication portion 530*b* communicates the inlet 530*c* and outlet 530*d*. An annular groove portion 530*e* is formed in the inner peripheral surface of the communication portion 530*b* at the portion near the outlet 530*d*. The opening diameter of the inlet 530*c* is about half the inner diameter of the communication portion 530*b*.

A filter 552A made from a coarse felt is fitted in the inlet side end of the communication portion 530*b*. The filter 552A is formed into a doughnut shape and has an outer diameter equal to or slightly larger than the inner diameter of the communication portion 530*b* and an inner diameter equal to the diameter of a first head portion 551A-1 (described later). The filter 552A has a filtering performance capable of trapping the soap base in the grease but allowing most of the oil components in the grease to pass therethrough.

A communication passage forming component 551 is inserted into the communication portion 530*b* and a major portion of the component 551 is at the outlet 530*d* side of the filter 552A. The communication passage forming component 551 includes a first head portion 551A-1, a second head portion 551A-2, a trunk portion 551D, and a flange portion 551E. The first head portion 551A-1 has an outer diameter smaller than the opening diameter of the inlet 530*c* and has one end protruding through the inlet 530*c* toward the speed reduction chamber 30*a*. The second head portion 551A-2 is connected to the other end of the first head portion 551A-1 and has an outer diameter smaller than the inner diameter of the connection portion 530*b* but larger than the opening diameter of the inlet 530*c*. The trunk portion 551D is positioned at the portion on the outlet 530*d* side of the second head portion 551A-2. The trunk portion 551D has a diameter larger than the inner diameter of the communication portion 530*b* prior to the assembly of the communication passage forming component 551 into the communication portion 530*b*. The flange portion 551E is fitted in the annular groove portion 530*e* at the position on the outlet 530*d* side of the trunk portion 551D. The communication passage forming component 551 is made from an oil resistant rubber material.

Because of the rubber material, the communication passage forming component 551 can easily be deformed and inserted to the communication portion 530*b*. Further, the flange portion 551E can easily be fitted in the annular groove portion 530*e*. Further, in a state where the communication passage forming component 551 has been fitted in the communication portion 530*b*, the trunk portion 551D is attached firmly to the inner surface of the communication portion 530*b* by the elasticity of the rubber material. Therefore, a minute space is hardly formed between the trunk portion 551D and communication portion 530*b*, preventing the grease from being leaked from between the trunk portion 551D and communication portion 530*b*. Further, mutual displacement between the trunk portion 551D and communication portion 530*b* does not occur.

Further, the fitting of the flange portion 551E in the groove portion 530*e* can fix the position of the communication passage forming component 551 with respect to the communication portion 530*b*, which can make the size of a communication passage 553 (described later) defined by the communication passage forming component 551 and the inner surface of the communication portion 530*b* suitable and uniform.

Further, the second head portion 551A-2 contacts and biases the filter 552A, so that the filter 552A is firmly held in the correct position and displacement hardly occurs, preventing a space or the like from being formed between the filter 552A and communication portion 530*b*.

An axial hole 551*c* is formed in the communication passage forming component 551. The axial hole 551*c* has an opening at the portion on the outlet 530*d* side of the trunk portion 551D and extends from the opening up to substantially the middle potion of the second head portion 551A-2. In the second head portion 551A-2, a radial hole 551*b* is formed. The radial hole 551*b* extends through the second head portion 551A-2 in the direction perpendicular to the axial hole 551*c* from the inside of the axial hole 551*c* toward the inner surface of the communication portion 530*b*. Accordingly, a bend portion exists at the portion where the radial hole 551*b* and axial hole 551*c* are connected to each other. The outer diameter of the second head portion 551A-2 is smaller than the inner diameter of the communication portion 530*b*, so that an annular space 551*a* is formed between the communication portion 530*b* and communication passage forming component 551. The annular space 551*a* extends from the surface of the filter 552A on the outlet 530*d* side to the portion near the radial hole 551*b*. The radial hole 551*b* opens to the surface of the second head portion 551A-2 that faces the inner surface of the communication portion 530*b* and, therefore, the radial hole 551*b* communicates with the space 551*a*. Since the radial hole 551*b* opens to the inner surface that defines the space 551*a*, a bend flowing portion exists at the portion where the space 551*a* and radial hole 551*b* are connected to each other. The space 551*a*, radial hole 551*b*, and axial hole 551*c* constitute the communication passage 553 with the space 551*a* defined as the upstream side. The communication passage forming component 551 is made from the rubber material as described above, so that a complicated path of the communication passage 553 can easily be formed.

Upon fitting engagement between the annular groove portion 530*e* and flange portion 551E, the communication passage forming component 551 is positioned at a predetermined position with respect to the communication portion 530*b*. In this state, the leading end of the first head portion 551A-1 extends through the opening of the filter 552A, and protrudes from the inlet 530*c*, and reaches the inside of the speed reduction chamber 30*a*. Therefore, the opening cross-sectional area of the inlet 530*c* is reduced. Further, the opening of the inlet 530*c* in the inlet/outlet direction is offset from the inlet opening end of the annular space 551*a* in the inlet/outlet direction. Therefore, the fluid that has entered the filter 552A dose not flow in the inlet/outlet direction, that is, does not take the shortest way for passing through the filter 552A, but flows in the direction from the downstream side opening of the inlet 530*c* toward the upstream side opening of the annular space 551*a*. As a result, effect of the filter 552A can be increased, enabling the filter 552A to trap the grease component more satisfactorily.

Since the trunk portion 551D has an outer diameter larger than that of the second head portion 551A-2, a stepped portion exists at a boundary between the trunk portion 551D and second head portion 551A-2. Further, the trunk portion 551D contacts the inner surface of the communication portion 530*b*, forming a dead-end alley at the stepped portion between the second head portion 551A-2 and trunk portion 551D. The stepped portion is defined as a first impediment portion 551B. A fluid flowing through the space 551*a* once collides against the first impediment portion 551B and flows into the radial hole 551*b* extending perpendicular to the direction that the fluid flows in the space 551*a*. A portion of the inner surface of the axial hole 551*c* that faces the opening of the radial hole 551*b* is defined as a second impediment portion 551C. The fluid flowing from the radial hole 551*b* collides against the second impediment portion 551C. Thereafter, the fluid flows along the axial hole 551*c*.

At the time when a pressure in the speed reduction chamber 30*a* is increased as described above and the air in the speed reduction chamber 30*a* is discharged to the atmosphere through the communication portion 530*b*, the air containing grease firstly enters the filter 552A in the communication portion 530*b* from the inlet 530*c*. When the air is passed through the filter 552A, the soap base having relatively high viscosity and having large particles in solid or droplet form contained in the grease are trapped by the filter 552A. That is, the oil component in the grease and air are passed through the filter 552A.

The air and the like that have passed through the filter 552A flows into the communication passage 553. The communication passage 553 has a plurality of bend portions, where the first and second impediment portions 551B and 551C are defined. Accordingly, the air that has been passed through the filter 552A and still contains the grease component collides against the first and second impediment portions 551B and 551C and thereby the flow of the air is disturbed to allow the grease component in the air to be adhered to the first and second impediment portions 551B and 551C. Further, the communication passage 553 has a complicated path structure including bend portions and the like, preventing the liquid grease from draining along the wall surface of the communication passage 553 due to fluidity or surface tension of the liquid grease. As a result, leakage of the grease to the atmosphere can be prevented.

A sixth embodiment will next be described with reference to FIG. 8. The hammer drill according to the sixth embodiment has the same configuration as that of the first embodiment except for the configuration relating to the communication forming portion 630B, and the description of the same part will be omitted.

Figure 8:
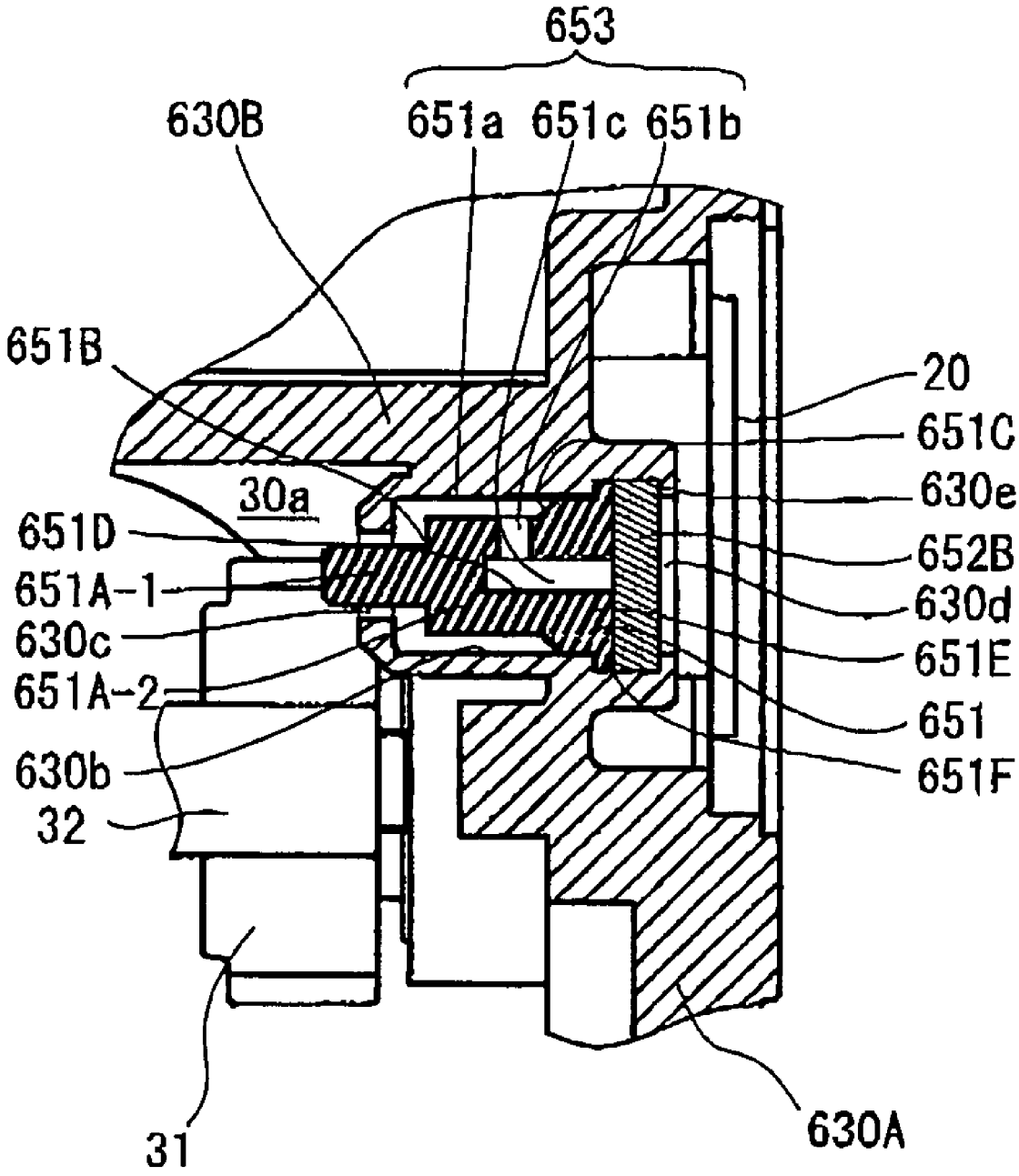
FIG. 8 is a cross-sectional view of an essential portion of a hammer drill according to a sixth embodiment of the present invention.

As shown in FIG. 8, a communication forming portion 630B is provided in the support member 63OA in the gear housing 30, and has an inlet 630*c* open to the speed reduction chamber 30*a* and an outlet 630*d* open to the inside of the motor housing 20 that communicates with an atmosphere. A communication portion 630*b* communicates the inlet 630*c* and outlet 630*d*. An annular groove portion 630*e* is formed in an inner peripheral surface of the communication portion 630*b* at the portion near the outlet 630*d*. An inner diameter of the inlet 630*c* is about half the inner diameter of the communication portion 630*b*.

A communication passage forming component 651 is inserted into the communication portion 630*b*. The communication passage forming component 651 has a first head portion 651A-1, a second head portion 651A-2, a trunk portion 651E, and a flange portion 651F. The first head portion 651A-1 has an outer diameter smaller than the inner diameter of the inlet 630*c* and has one end protruding from the inlet 630*c* toward the speed reduction chamber 30*a*. The second head portion 651A-2 is connected to the other end of the first head portion 651A-1 and has a diameter smaller than the inner diameter of the connection portion 630*b* but larger than the inner diameter of the inlet 630*c*. The trunk portion 651E is provided at the outlet 630*d* side of the second head portion 651A-2. The trunk portion 651E has an outer diameter larger than the inner diameter of the communication portion 630*b* prior to assembly of the communication passage forming component 651 into the communication portion 630*b*. The flange portion 651F is fitted in the annular groove portion 630*e* at the outlet 630*d* side of the trunk portion 651E. The communication passage forming component 651 is made from an oil resistant rubber material.

Because of the rubber material, the communication passage forming component 651 can easily be deformed and inserted to the communication portion 630*b*. Further, the flange portion 651F can easily be fitted in the annular groove portion 630*e*. Further, in a state where the communication passage forming component 651 has been fitted in the communication portion 630*b*, the communication passage forming component 651 is attached firmly to the inner peripheral surface of the communication portion 630*b* by the elasticity of the rubber material. Therefore, a minute gap is hardly formed between the communication passage forming component 651 and communication portion 630*b*, preventing the grease from being leaked from between the communication passage forming component 651 and communication portion 630*b*.

Further, the fitting of the flange portion 651F in the annular groove portion 630*e* can fix the position of the communication passage forming component 651 in the communication portion 630*b*, which can make the size of a communication passage 653 (described later) defined by the communication passage forming component 651 and the inner surface of the communication portion 630*b* suitable and uniform. Further, mutual displacement between the component 651 and the communication portion 630*b* does not occur.

An axial hole 651*c* is formed in the communication passage forming component 651. The axial hole 651*c* has an opening at the portion on the outlet 630*d* side of the trunk portion 651E and extends from the opening up to substantially the middle potion of the second head portion 651A-2. In the second head portion 651A-2, a radial hole 651*b* is formed. The radial hole 651*b* extends through the second head portion 651A-2 in the direction perpendicular to the axial hole 651*c* from the inside of the axial hole 651*c* toward the inner surface of the communication portion 630*b*. Accordingly, a bend flowing portion exists at the portion where the radial hole 651*b* and axial hole 651*c* are connected to each other. The outer diameter of the second head portion 651A-2 is smaller than the inner diameter of the communication portion 630*b*, so that an annular space 651*a* is formed between the inner surface of the communication portion 630*b* and second head portion 651A-2. The annular space 651*a* extends from the inlet 630*c*. The radial hole 651*b* opens to the surface of the second head portion 651A-2 that faces the inner surface of the communication portion 630*b* and, therefore, the radial hole 651*b* communicates with the annular space 651*a*. Since the radial hole 651*b* opens to the inner surface that defines the space 651*a*, a bend portion exists at the portion where the space 651*a* and radial hole 651*b* are connected to each other. The space 651*a*, radial hole 651*b*, and axial hole 651*c* constitute the communication passage 653 with the space 651*a* defined as the upstream side. The communication passage forming component 651 is made from the rubber material as described above, so that a complicated path of the communication passage 653 can easily be formed.

Upon fitting engagement between the annular groove portion 630*e* and flange portion 651F, the communication passage forming component 651 is positioned at a predetermined position with respect to the communication portion 630*b*. In this state, the first head portion 651A-1 protrudes from the inlet 630*c* and enters the speed reduction chamber 30*a*, so that the opening cross-sectional area of the inlet 630*c* is reduced.

A first impediment portion 651B is defined at the boundary between the second head portion 651A-2 and the first head portion 651A-1, When a fluid from the inlet 630*c* flows into the space 651*a*, the fluid collides against the first impediment portion 651B. Since the trunk portion 651E has a diameter larger than that of the second head portion 651A-2, a stepped portion exists at a boundary between the second head portion 651A-2 and trunk portion 651E. Further, the trunk portion 651E contacts the inner surface of the communication portion 630*b*, forming a dead-end alley at the stepped portion between the second head portion 651A-2 and trunk portion 651E. The stepped portion is defined as a second impediment portion 651C. The fluid flowing through the space 651*a* once collides against the second impediment portion 651C and flows into the radial hole 651*b* extending perpendicular to the direction that the fluid flows in the space 651*a*. The inner surface of the axial hole 651*c* that faces the opening of the radial hole 651*b* is defined as a third impediment portion 651D. The fluid from the radial hole 651*b* collides against the third impediment portion 651D. Thereafter, the fluid flows along the axial hole 651*c*.

At the portion on the outlet 630*d* side of the communication passage forming component 651 within the communication portion 630*b*, a filter 652B is fitted in the annular grove portion 630*e*. The filter 652B is made of a dense felt and can trap the oil component in the grease. Further, since the filter 652B is fitted in the annular groove portion 630*e*, the communication passage forming component 651 is urged toward the inlet 630*c* side and is firmly held, thereby avoiding displacement of the component 651.

At the time when a pressure in the speed reduction chamber 30*a* is increased and the air in the speed reduction chamber 30*a* is discharged to the atmosphere through the communication portion 630*b*, the air firstly flows into the communication passage 653 in the communication portion 630*b* from the inlet 630*c*. The communication passage 653 has a plurality of bend portions, where the first to third impediment portions 651B to 651D are defined. Accordingly, the air containing the grease component collides against the first to third impediment portions 651B to 651D, whereby the flow of the air is disturbed to allow the grease component contained, in a mist or liquid form, in the air to be adhered to the first to third impediment portions 651B to 651D.

The air and the like that have been passed through the communication passage 653 flows into the filter 652B. Since the felt provides high filtration capability, the filter 652B can trap oil component and the like out of the air, thus preventing the oil component from being discharged outside the filter 652B. Further, the communication passage 653 has a complicated path structure including bend portions and the like, preventing the liquid grease from draining along the wall surface of the communication passage due to fluidity or surface tension of the liquid grease. As a result, leakage of the grease to the outside can further be prevented.

In the sixth embodiment, another filter made from a material coarser than that of the filter 652B can be disposed in the communication portion 630*b* at the portion near the inlet 630*c* to trap the soap base in the grease component. This further prevents the grease component from being discharged to the atmosphere.

While the invention has been described in detail and with reference to specific embodiments thereof, it would be apparent to those skilled in the art that various changes and modifications may be made therein without departing from the spirit and scope of the invention. For example, although the communication passage forming component is made from the rubber material, oil resistant resin is also available. Alternatively, the communication passage forming component may be made from a metal. In the latter case, when the communication passage forming component is fixed to the communication portion, it is only necessary to force-fit the communication passage forming component, eliminating the need to form the groove portion and the like in the communication portion. This can simplify the manufacturing process.

Although the filter is preferably made from the felt, any material can be used as long as the filter can perform filtration function. Further, in the first and second embodiments, the first and second filters are provided, and the first filter is disposed near the inlet of the communication portion and second filter is disposed near the outlet of the communication portion. Alternatively, however, the first filter can be disposed on the wall surface of the communication forming portion on the speed reduction chamber side so as to cover the inlet. Similarly, the second filter may be disposed on the wall surface of the communication forming portion on the motor housing side so as to cover the outlet. This configuration allows the communication portion to be covered by the first and second filters. This eliminates the need to form the annular groove portion and the like for the fixation of the filter in the communication portion, thereby simplifying the manufacturing process.

In the first, and third to sixth embodiments, the communication passage is provided by the communication portion and communication portion forming component. Alternatively, however, the communication passage can be provided only by the communication portion forming component. In the latter case, an axial groove in communication with the radial hole must be formed at the outer peripheral surface of the communication portion forming component.

What is claimed is:

1. A power tool comprising:

a housing defining therein a mechanism chamber, a lubricant being inserted in an interior of the mechanism chamber;

an electric motor accommodated in the housing;

a speed change mechanism disposed in the mechanism chamber and connected to the motor for shift-transmitting rotation of the motor;

a communication forming portion provided in the housing; and a communication passage forming member fitted in the communication forming portion for providing a communication passage communicating an interior of the mechanism chamber with an exterior of the mechanism chamber, the communication passage forming member and the communication forming portion cooperably providing at least two impediment portions that restrain leakage of the lubricant to the exterior of the mechanism chamber, and the communication passage forming member itself providing at least one impediment portion of the at least two impediment portions that restrains leakage of the lubricant to the exterior of the mechanism chamber.

2. The power tool as claimed in claim 1, wherein the communication forming portion is formed with a communication portion having an inlet open to the mechanism chamber and an outlet; and wherein the communication passage forming member is fitted in the communication portion for providing the communication passage communicating the interior of the mechanism chamber through the inlet with the exterior of the mechanism chamber through the outlet; and wherein a part of the communication passage defines the at least one impediment portion for allowing an air and the lubricant entered into the communication passage through the inlet to be impinged on the at least one impediment portion.

3. The power tool as claimed in claim 2, wherein the communication portion has an inner diameter, and the communication passage forming member has an outer diameter greater than the inner diameter prior to assembly of the communication passage forming member into the communication portion.

4. The power tool as claimed in claim 2, wherein the communication portion includes a position defining portion that defines a resultant position of the communication passage forming member in the communication portion.

5. The power tool as claimed in claim 2, further comprising:

a first filter disposed for blocking the communication portion and positioned close to the inlet; and a second filter disposed for blocking the communication portion and positioned close to the outlet.

6. The power tool as claimed in claim 5, further comprising:

a cylinder supported in the housing and rotatable about a rotation axis of the cylinder, an end tool being attachable to the cylinder; and a rotation transmission mechanism that transmits rotation of the motor to the cylinder for rotating the cylinder about the rotation axis.

7. The power tool as claimed in claim 5, wherein the first filter provides a first filtering performance and the second filter provides a second filtering performance higher than the first filtering performance.

8. The power tool as claimed in claim 5, wherein the first filter and the second filter are made from a felt material.

9. The power tool as claimed in claim 5, wherein the communication portion includes a first filter positioning portion for positioning the first filter at a first position, and a second filter positioning portion for positioning the second filter at a second position.

10. The power tool as claimed in claim 5, wherein the communication passage forming member is positioned between the first filter and the second filter.

11. The power tool as claimed in claim 1, further comprising:

a cylinder supported in the housing and rotatable about a rotation axis of the cylinder, an end tool being attachable to the cylinder; and a rotation transmission mechanism that transmits rotation of the motor to the cylinder for rotating the cylinder about the rotation axis.

12. The power tool as claimed in claim 1, wherein the communication passage forming member is made from an elastic material.

13. A power tool comprising:

a housing defining therein a mechanism chamber, a lubricant being filled in an interior of the housing;

an electric motor accommodated in the housing;

a speed change mechanism disposed in the mechanism chamber and connected to the motor for shift-transmitting rotation of the motor;

a communication forming portion provided in the housing and formed with a communication portion having an inlet open to the mechanism chamber and an outlet in communication with the inlet;

a first filter positioned close to the inlet of the communication portion and disposed for blocking the communication portion at the inlet thereof;

a second filter positioned close to the outlet of the communication portion and disposed for blocking the communication portion at the outlet thereof;

a cylinder supported in the housing and rotatable about a rotation axis of the cylinder, an end tool being attachable to the cylinder; and a rotation transmission mechanism that transmits rotation of the motor to the cylinder for rotating the cylinder about the rotation axis;

wherein the first filter and the second filter are spaced from one another by at least parts of the communication portion.

14. A power tool A power tool comprising:

a housing defining therein a mechanism chamber, a lubricant being filled in an interior of the housing;

an electric motor accommodated in the housing;

a speed change mechanism disposed in the mechanism chamber and connected to the motor for shift-transmitting rotation of the motor;

a communication forming portion provided in the housing and formed with a communication portion having an inlet open to the mechanism chamber and an outlet in communication with the inlet;

a first filter disposed for blocking the communication portion and positioned close to the inlet; and a second filter disposed for blocking the communication portion and positioned close to the outlet;

wherein the first filter provides a first filtering performance and the second filter provides a second filtering performance higher than the first filtering performance.

15. A power tool A power tool comprising:

a housing defining therein a mechanism chamber, a lubricant being filled in an interior of the housing;

an electric motor accommodated in the housing;

a speed change mechanism disposed in the mechanism chamber and connected to the motor for shift-transmitting rotation of the motor;

a communication forming portion provided in the housing and formed with a communication portion having an inlet open to the mechanism chamber and an outlet in communication with the inlet;

a first filter disposed for blocking the communication portion proximate to the inlet of the communication portion; and a second filter disposed for blocking the communication portion proximate to the outlet of the communication portion;

wherein the first filter and the second filter are spaced from one another at least by parts of the communication portion and are made from a felt material.

16. A power tool A power tool comprising:

a housing defining therein a mechanism chamber, a lubricant being filled in an interior of the housing;

an electric motor accommodated in the housing;

a speed change mechanism disposed in the mechanism chamber and connected to the motor for shift-transmitting rotation of the motor;

a communication forming portion provided in the housing and formed with a communication portion having an inlet open to the mechanism chamber and an outlet in communication with the inlet;

a first filter disposed for blocking the communication portion and positioned close to the inlet; and a second filter disposed for blocking the communication portion and positioned close to the outlet;

wherein the communication forming portion includes a first filter positioning portion for positioning the first filter at a first position, and a second filter positioning portion for positioning the second filter at a second position.

17. A power tool comprising:

a housing defining therein a mechanism chamber, a lubricant being filled in an interior of the housing;

an electric motor accommodated in the housing;

a speed change mechanism disposed in the mechanism chamber and connected to the motor for shift-transmitting rotation of the motor;

a communication forming portion provided in the housing and formed with a communication portion having an inlet open to the mechanism chamber and an outlet in communication with the inlet;

a first filter disposed for blocking the communication portion and positioned close to the inlet; and a second filter disposed for blocking the communication portion and positioned close to the outlet; a communication passage forming member fitted in the communication portion and between the first filter and the second filter for providing a communication passage communicating an interior of the mechanism chamber with an exterior of the mechanism chamber in combination with the communication portion, at least one of the communication passage forming member and the communication forming portion providing an impediment portion at a part of the communication passage for allowing an air and the lubricant entered into the communication passage through the first inlet and the first filter to be impinged on the impediment portion.

18. A power tool comprising:

a housing defining therein a mechanism chamber, a lubricant being filled in an interior of the housing;

an electric motor accommodated in the housing;

a speed change mechanism disposed in the mechanism chamber and connected to the motor for shift-transmitting rotation of the motor;

a communication forming portion provided in the housing and formed with a communication portion having an inlet open to the mechanism chamber and an outlet in communication with the inlet;

a first filter disposed for blocking the communication portion and positioned close to the inlet; and a second filter disposed for blocking the communication portion and positioned close to the outlet;

wherein the communication portion has an inner peripheral surface having annular projections and annular recesses alternately arrayed in a direction from the inlet to the outlet.

* * * * *